United States Patent [19]

Seiler

[11] Patent Number: 4,530,380

[45] Date of Patent: Jul. 23, 1985

[54] SINGLE-LEG HOOK FOR A DOUBLE LIFT OPEN SHED JACQUARD LOOM

[75] Inventor: Wolfgang Seiler, Monchen-Gladbach, Fed. Rep. of Germany

[73] Assignee: FA. Oskar Schleicher, Fed. Rep. of Germany

[21] Appl. No.: 537,247

[22] Filed: Sep. 28, 1983

[30] Foreign Application Priority Data

Apr. 12, 1983 [DE] Fed. Rep. of Germany ..... 3313617

[51] Int. Cl.[3] ..... D03C 3/00

[52] U.S. Cl. ..... 139/59

[58] Field of Search ..... 139/59, 65, 62, 63, 139/64

[56] References Cited

U.S. PATENT DOCUMENTS

| | | | |
|---|---|---|---|
| 2,941,551 | 6/1960 | Ballard | 139/59 |
| 3,455,339 | 7/1969 | Seiler | 139/59 |
| 3,967,652 | 7/1976 | Seiler | 139/65 X |

*Primary Examiner*—Henry S. Jaudon
*Assistant Examiner*—Tracy Graveline
*Attorney, Agent, or Firm*—King, Liles & Schickli

[57] ABSTRACT

A single-leg hook for a double lift open shed Jacquard machine with two sets of blades which are movable in opposite directions towards and away from each other by lift means, without crossing, a stationary set of arresting blades and a stationary hook rack, has first and second suspension projections which face in the same direction, and a support projection which points in the same direction. In one embodiment, the major, lower portion of the leg of the hook is rigid while the upper end portion is flexible, and the suspension projections are disposed at respective ends of a bar member fixed to the upper end of the hook. In another embodiment, the leg of the hook is rigid throughout and one of the suspension projections is arranged at its upper end, with the other suspension projection disposed on a resilient bar connected by an end region to the rigid leg.

9 Claims, 5 Drawing Figures

2
6
5
7
3
1
A
4

2'
6
7'
5
3'
1'
4

2a
11
10
3a
9
8
4

2a'
11
10'
3a'
9'
8'
4

27
29
B
28
C
17
19
21
15
16
12
13
14
18
20
22
1
1'
26
4
25
24
23

SINGLE-LEG HOOK FOR A DOUBLE LIFT OPEN SHED JACQUARD LOOM

BACKGROUND OF THE INVENTION

The present invention relates generally to a Jacquard loom and to a single-leg hook for a double lift open shed Jacquard loom.

In one form of such a machine in which the hooks are controlled by control needles and which includes sets of blades or knives which are movable in opposite directions towards and away from each other, without crossing, by means of lift devices, and a stationary set of arresting knives or blades, as well as a stationary hook rake for guiding the hooks, each hook has two suspension noses or projections which point in the same direction, and a support nose or projection which faces in the same direction. The suspension projections are disposed at the end of a substantially bar-like portion which can be deflected relative to the relatively rigid lower portion of the leg of the hook, which constitutes the predominant part of the leg of the hook.

A hook construction of the general kind outlined above is to be found in German patent specification No. 1 299 258. In that design of hook, the projections thereon are disposed at the ends of a double-armed lever member which is mounted rotatably on the leg of the hook, which is of an overall rigid construction. From a central position in which both projections on the hook can come into engagement with their ends, with the associated blades or knives, the lever member is pivoted about the pivot mounting of the lever member, against the action of a return force, by engagement of the knives or blades into a projection, whereby the other projection is moved to a position outside the region of action of the other blade or knife, and cannot therefore be engaged thereby. The mounting means required to permit the rotational movement of the double-armed lever member constitutes a disadvantage as dust and dirt can penetrate into the mounting means and resinified or gummy grease or oil can result in the lever member becoming unable to rotate. In addition, a separate spring is required in order to produce the return force, thereby to ensure that the lever member takes up a precise central position. By virtue of the action of the one blade or knife, the double-armed lever member must be pivoted beyond the front edge of the leg of the hook by the amount by which the suspension projection projects beyond that front edge, in the central position, so that the other projection is retracted to such an extent that it moves outside the range of action of the knife which moves theretowards. For that reason, the projections on the known hook must be in the form of hook portions which project to a substantial extent. As a result of that construction however, in the phase of operation resulting in engagement with the knife, there is a substantial idle stroke movement or lost motion which has a detrimental effect from the point of view of smoothness of operation.

In another form of hook for a double lift open shed Jacquard machine, of the general kind set forth above, the lower portion of the hook is deflected in the region of intersection of the knives. Thus, in the construction which is disclosed in U.S. Pat. No. 4,060,101, the upper knife box or chest is deflected, which results in a deflection movement of the leg of the hook in the lower region, while in another construction, as disclosed in German laid-open application (DE-OS) No. 23 44 363, the upper portion of a hook has a bulge or curved portion which causes deflection thereof, in the lower region of the hook. However, hooks of that kind are not particularly suitable for high operating speeds because, besides the movement that is necessarily required, the hooks perform uncontrolled movements in the region of intersection, and such movements result in vibration, cause smoothness of operation of the machine to be impaired, and also result in defective control of the assembly, thereby also resulting in defects in the article being produced.

SUMMARY OF THE INVENTION

An object of the present invention is to provide a new and improved single-leg hook for a Jacquard loom.

Another object of the present invention is to provide a hook for a double lift open shed Jacquard loom, which permits higher operating speeds thereof.

Yet another object of the present invention is to provide a single-leg hook for a Jacquard loom which does not require a deflection movement in the lower region of the hook, in the region of hook intersection, without however having to tolerate the disadvantages involved in pivotally mounting a double-armed lever carrying the projections of the hook.

A further object of the present invention is to provide a hook for a double lift open shed Jacquard loom which does not suffer from oscillation or vibration or defective operation thereof, due to uncontrolled movements of the hooks in the region in which they cross, thereby enhancing the smoothness of operation of the loom.

A still further object of the invention is to provide a Jacquard loom incorporating the new and improved single-leg hook.

In accordance with the present invention, these and other objects are achieved by a single-leg hook in the harness draw means of a double lift open shed Jacquard machine in which the hooks are controlled by control needles and which has two sets of blades or knives which are movable in opposite directions towards and away from each other by lift means, without crossing, and a stationary set of arresting knives, as well as a stationary hook rake for guidance of the hooks. Each hook has two suspension noses or projections which point in the same direction, and a support projection or nose which points in the same direction. In one alternative embodiment of the principles of the present invention, the suspension projections are disposed at the end or terminus of a for example substantially bar-like member which can be deflected relative to the relatively rigid lower portion of the leg of the hook, which constitutes the major part of the leg of the hook. The upper end portion of the leg of the hook is of a resilient nature and the member which carries the suspension projections is fixedly connected to the upper end region of the resilient end portion of the leg of the hook.

In the above-indicated arrangement, deflection movement of the lower part of the leg of the hook is avoided as the upper end portion of the leg of the hook is of a resilient nature, and the deflection movement of the bar-like member is produced by pivotal motion of the resilient upper end region of the leg of the hook. Eliminating the above-mentioned deflection movement of the lower part of the leg of the hook means that defects in operational control are avoided and smoothness of operation of the machine is enhanced. In addition, the hook does not have any pivot mounting means for the bar-like member, with all the disadvantages that that involves. Furthermore, the hook portions forming the projections of the hook can be shorter than in the prior-art configuration discussed above, thereby giving the advantage that the hooks start up at a later time in the operating cycle of the machine, so that their impact on the hook base member is less severe. There is no need for a separate spring for holding the part of the hook carrying the hook projections, in a central position, as referred to in connection with the prior-art arrangement discussed above. In addition, manufacture of the hook constructed in accordance with the principles of this invention is substantially less expensive than manufacture of a hook with a pivotally mounted lever member thereon.

In accordance with further features of the invention, the substantially bar-like member carrying the projections of the hook may be of a rigid construction, or it may be of a resiliently elastic construction. The term 'rigid' in this context, in accordance with the invention, means that the hooks are rigid, in the direction of the control needles or in the direction of the notional plane which passes through the suspension projections and the support projections, or are at least rigid in that plane.

In another aspect of a single-leg hook, in accordance with the present invention, for a double-lift open shed Jacquard machine in which the hooks are controlled by control needles and which has two sets of blades or knives movable towards and away from each other by lift means, without crossing, together with a stationary set of arresting knives, and a stationary hook rake for guiding the hooks, each hook has two suspension projections or noses which face in the same direction, and a support projection or nose which points in the same direction, wherein one of the suspension projections is disposed at the upper end of the leg of the hook, which in this embodiment is of a relatively rigid nature throughout, while the second projection is disposed on a resilient, for example substantially bar-like member which is connected by an end portion thereof to the relatively rigid leg of the hook. When the resilient bar member is deflected, the upper end of the relatively rigid leg of the hook is pressed away against the hook rake, with the result that the upper end portion of the leg of the hook, which carries the first-mentioned suspension projection, in spite of the relatively rigid nature of the leg of the hook, is deflected in the opposite direction to the direction of deflection of the resilient bar member mounted thereon, in such a way that the suspension projection disposed thereon moves into a position outside the range of engagement of the upper knife or blade. It should be appreciated that this alternative embodiment also enjoys the advantages over the prior-art constructions, as already discussed above in relation to the first alternative embodiment of the arrangement according to this invention.

Further objects, features and advantages of the present invention will be more clearly apparent from the following detailed description of preferred embodiments.

DESCRIPTION OF PREFERRED EMBODIMENTS

Figures 1, 2, 3, 4, 5:
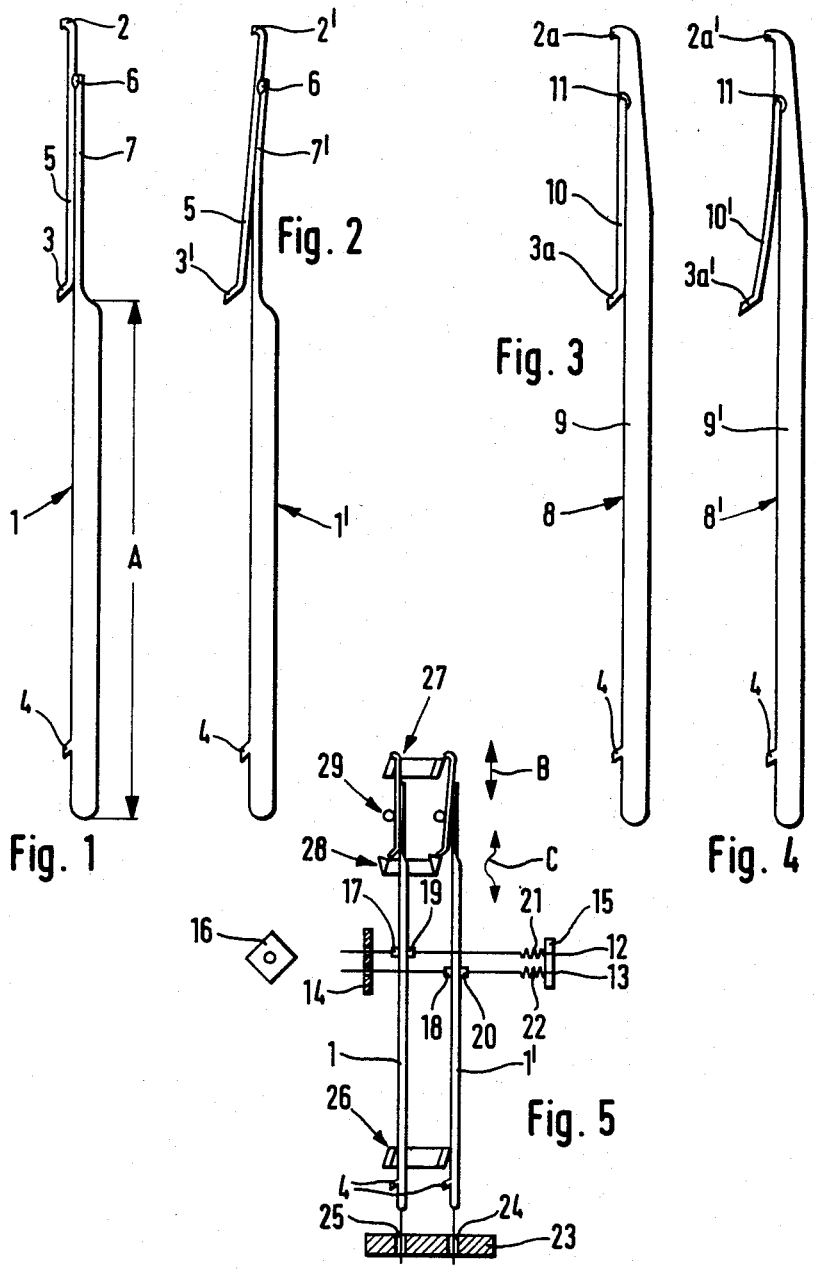
FIG. 1 shows a side view of a first embodiment of a hook in accordance with this invention.
FIG. 2 shows a view corresponding to that shown in FIG. 1 of the hook in an operated position.
FIG. 3 shows a view corresponding to FIG. 1 of a further embodiment of a hook according to the invention.
FIG. 4 shows a view corresponding to FIG. 2 of the second embodiment of the hook.
FIG. 5 shows a diagrammatic view of parts of a double lift open shed Jacquard machine, illustrating only two control needles and two hooks, for the sake of greater clarity of the drawing.

Referring firstly to FIGS. 1 and 2, shown therein is a hook in accordance with the invention, as indicated generally by reference numeral 1. The hook 1 has a portion, indicated by A, which is relatively rigid and which forms the predominant or major part of the leg of the hook. As indicated above, the term rigid in this context means that the hook is rigid at least in the direction of the control needles or in the direction of the notional plane extending through suspension projections 2 and 3 and support projection 4, which will be described in greater detail hereinafter.

In the illustrated embodiment, the portion A of the leg of the hook is of a flat bar-like nature.

The hook 1 has two suspension projections or engagement means 2 and 3 which point at least substantially in the same direction, being disposed in the upper end region of the leg of the hook, and a support projection or engagement means 4 which faces in the same direction and which is disposed adjacent the lower end of the hook, in the upright position as illustrated for example in FIG. 1. While the projection 4 is disposed on the relatively rigid portion A of the leg of the hook, the first and second projections 2 and 3 are disposed on a member 5 which is of a relatively rigid nature, and which is for example of a bar-like configuration. The bar member 5 is fixedly connected to the upper end region 7 of the upper end of the leg of the hook, as by a weld indicated at 6. The upper end portion 7 of the leg of the hook is of a resilient or elastic nature. By virtue of such resiliency, the bar member 5 carrying the projections 2 and 3 can be pivoted from the position shown in FIG. 1, being the rest position, into the operative position shown in FIG. 2 in which the projections 2 and 3 take up the respective positions indicated by references 2' and 3' in FIG. 2, while the upper end portion 7 is pivoted into the operative position indicated in FIG. 2 by reference numeral 7'.

The mode of operation of this embodiment of the hook will be described after having described the construction of the second embodiment of the hook shown in FIGS. 3 and 4.

Referring therefore now to FIGS. 3 and 4, shown therein is a further embodiment of the hook, indicated by reference numeral 8, which differs from the hook construction shown in FIGS. 1 and 2, substantially in that the leg 9 of the hook 8 is of a relatively rigid nature throughout, while the upper suspension projection which in FIG. 3 is indicated by reference numeral **2*a* is disposed at the upper end of the relatively rigid leg 9 of the hook. The lower suspension projection 3*a* is disposed on a resilient member 10 which is for example of substantially bar-like configuration and which is joined to the relatively rigid leg 9 of the hook 8, at an end region of the member 10, more specifically by a weld as indicated at 11 in the illustrated embodiment. FIG. 4 shows the operative position of the hook in which the member 10 has been pivoted into a position 10' in which the lower suspension projection 3a takes up the position indicated by 3a' and the upper suspension projection 2a is pivoted into the position 2a', by a general pivotal movement of the leg of the hook, into the position indicated by 9'**.

Reference will now be made to the diagrammatic view of part of a Jacquard loom in FIG. 5, illustrating two control needles 12 and 13 which are mounted in the usual way in a perforated needle board 14 and a needle rake 15 and which can be controlled in the conventional fashion by means of a square card cylinder indicated at 16. The control pulses originating from the card cylinder 16 are transmitted to the hooks 1 (FIGS. 1 and 2) or 8 (FIGS. 3 and 4) by way of the control needles 12 and 13 and the angle lugs or projections 17 and 18 respectively disposed on the control needles 12 and 13. It will be appreciated that, although FIG. 5 has reference numerals 1 and 1' to denote the hooks employed in the illustrated arrangement, such hooks could readily be replaced by the hooks 8, 8' shown in FIGS. 3 and 4.

Return movement of the hooks 1 or 8 is produced by the action of angle projections or lugs 19 and 20 which are carried on the respective needles 12 and 13 and which apply to the hooks the force applied to the needles 12 and 13 by respective needle springs 21 and 22.

The hook base or bottom member is indicated by reference numeral 23 in FIG. 5, and has bores or holes 24 and 25 through which pass straps or bands which connect to the harness (not shown) and which are joined to the bottom ends of the respective hooks. A stationary set of arresting blades or knives is generally indicated by 26.

The illustrated arrangement also has first and second sets of blades or knives 27 and 28 which can be moved in opposite directions towards and away from each other, without crossing, by lift means (not shown herein), and a stationary hook rake 29. In the arrangement illustrated in FIG. 5, the upper set of knives 27 can be moved up and down in a straight line, as indicated by the double-headed arrow B, while the lower set of knives 28 performs a non-rectilinear motion as indicated by double-headed arrow C and which differs from the rectilinear motion B insofar as the set of knives 28, which is disposed in a knife chest or box in the usual manner, additionally performs a transverse movement towards the card cylinder 16, which has its maximum deflection at the point of crossing of the hooks which move upwardly and downwardly respectively. FIG. 5 shows the position of crossing of the hooks, wherein for example the left-hand hook denoted by reference numeral 1 is moving upwardly and the right-hand hook denoted by reference numeral 1' is moving downwardly (or vice-versa). In that position of the arrangement, the lower set of knives 28 has reached its position of maximum deflection towards the card cylinder 16. The hook 1', which is in the operative position illustrated in FIG. 2, is supported with its lower projection 3' (or 3a' if the needle 8 shown in FIGS. 3 and 4 is used) on the associated knife of the set of knives 28, and is thus in a deflected condition. In that condition, the member 5 (or the member 10 of the FIGS. 3 and 4 hook) bears or is braced against the hook rake 29, with the result that the upper end 7 of the leg of the hook 1 shown in FIGS. 1 and 2 is pivoted into a position corresponding to the position 7' shown in FIG. 2. As a result of such movement, the upper projection 2 moves into the position indicated by 2' in FIG. 2, being the position in which it is outside the range of action of the associated knife of the set of knives 27. Similarly, when the loom uses the hook 8 shown in FIGS. 3 and 4, the hook 8 bears against the stationary hook rake 29 through the resilient member 10, in the above-described position of the arrangement. The deflective movement of the blade 28 in contact with the projection 3a causes the resilient member 10 to move into the position 10' shown in FIG. 4. This results in an intermediate space between the projection 3a' and the leg 9'. Since the hook rack 29 is stationary and bears against the member 10, the upper end of the relatively rigid leg 9 of the hook, that carries the projection 2a, is necessarily deflected in the opposite direction to the direction in which the lower end of the member 10 is deflected, whereby the projection 2a is moved into the position 2a' in which it is outside the range of engagement of the associated knife of the upper set 27.

It will be seen therefore that the above-described hook constructions are simple in construction, not requiring any form of pivot mountings for the projection-carrying members, while also being reliable in operation and permitting higher speeds of operation and contributing to enhanced smoothness of operation of the machine.

It will be appreciated that the above-described embodiments are given only by way of example of the teaching in accordance with the principles of this invention, and that various modifications and alterations may be made therein without thereby departing from the spirit and scope of this invention.

I claim:

1. A single-leg hook for a double lift open shed Jacquard loom including a plurality of control needles for controlling shedding hooks, first and second sets of blades movable in opposite directions towards and away from each other without crossing, and a stationary hook rack, comprising a leg having first and second ends, a substantial part of said leg extending from said first end towards said second end being relatively rigid, and a further part of said leg extending from said second end towards said rigid part being resiliently flexible, and a member fixedly connected to the second end region of said leg and providing first and second suspension projections which face at least substantially in the same direction and which are adapted selectively to engage said blades of said first and second sets of blades, said member being deflectable relative to the relatively rigid part of the leg of the hook.

2. A hook as set forth in claim 1 wherein said leg further comprises a support projection disposed at a position towards said first end of said leg and adapted selectively to co-operate with arresting blades of said loom.

3. A hook as set forth in claim 1 wherein said member carrying said first and second projections is at least substantially rigid.

4. A hook as set forth in claim 1 wherein said member carrying said first and second projections is resiliently flexible.

5. A single-leg hook for a double lift open shed Jacquard loom including a plurality of control needles for controlling shedding hooks, first and second sets of blades movable in opposite directions towards and away from each other without crossing and a stationary hook rack, comprising a relatively rigid leg having first and second ends, a first suspension projection disposed at least substantially at said second end of the leg of the hook, a carrier member having a first and second terminus, said first terminus of said carrier member being fixedly connected to said leg adjacent said second end thereof and a second suspension projection being provided on said carrier member at least adjacent to said second terminus thereof, the first and second suspension projections facing at least substantially in the same direction and being adapted selectively to engage said blades of said first and second sets of blades.

6. A hook as set forth in claim 5 wherein a support projection is disposed on said leg towards the first end thereof and faces in substantially the same direction, thereby adapted to co-operate with arresting blades of a said loom.

7. A hook as set forth in claim 5, wherein said carrier member is resilient and thereby, deflectable relative to said leg.

8. A single-leg hook for a double lift open shed Jacquard loom comprising an elongate leg having first and second ends, at least a substantial portion of the length of the leg, starting from said first end towards said second end, being relatively rigid, a support projection disposed on said rigid portion of said leg adjacent said first end thereof, and first and second suspension projections which are disposed on a portion of said leg adjacent said second end thereof and which face at least substantially in the same direction, said portion of said leg which carries said first and second suspension projections being resiliently deflectable relative to said rigid portion of said leg.

9. A hook as set forth in claim 8 wherein said resiliently deflectable portion comprises a bar-like member having a first and second terminus, said first and second suspension projections being disposed at respective ones of said termini of said bar member and said bar member being fixedly connected at a position intermediate the termini thereof to said second end of said leg of the hook, an end portion of said leg extending from its said second end towards its said relatively rigid portion being resiliently flexible.

* * * * *